US006363995B1

(12) United States Patent
Baranzke

(10) Patent No.: US 6,363,995 B1
(45) Date of Patent: Apr. 2, 2002

(54) DEVICE AND METHOD FOR MANUFACTURING AN ENGINE BLOCK

(75) Inventor: Matthias Baranzke, Rehlingen-Siersburg (DE)

(73) Assignee: VAW alucast GmbH, Dillingen (DE)

( * ) Notice: Subject to any disclaimer, the term of this patent is extended or adjusted under 35 U.S.C. 154(b) by 0 days.

(21) Appl. No.: 09/438,636

(22) Filed: Nov. 12, 1999

(30) Foreign Application Priority Data

Nov. 21, 1998 (DE) ..... 198 53 803

(51) Int. Cl.[7] ..... B22D 19/00; B22D 33/04; B22D 17/24

(52) U.S. Cl. ..... 164/100; 164/9; 164/137; 164/332

(58) Field of Search ..... 164/100, 310, 164/349; 205/224, 227, 170

(56) References Cited

U.S. PATENT DOCUMENTS

| | | | | |
|---|---|---|---|---|
| 3,165,983 A | * | 1/1965 | Thomas | 92/169 |
| 4,757,857 A | | 7/1988 | Henkel | 164/137 |
| 5,179,994 A | * | 1/1993 | Kuhn | 164/100 |
| 5,361,823 A | * | 11/1994 | Kuhn et al. | 164/9 |
| 5,365,997 A | | 11/1994 | Helgesen et al. | 164/103 |
| 5,771,955 A | * | 6/1998 | Helgesen et al. | 164/9 |
| 5,931,213 A | | 8/1999 | Khalili et al. | 164/127 |

FOREIGN PATENT DOCUMENTS

| | | | |
|---|---|---|---|
| DE | 3419979 | | 4/1986 |
| DE | 4442453 | A1 * | 11/1994 |
| DE | 195 33 529 | A1 | 3/1997 |
| DE | 197 55 557 | C1 | 2/1999 |
| EP | 0532331 | | 3/1993 |
| FR | 1247477 | | 10/1960 |

* cited by examiner

*Primary Examiner*—M. Alexandra Elve
*Assistant Examiner*—Kevin McHenry
(74) *Attorney, Agent, or Firm*—Friedrich Kueffner

(57) ABSTRACT

A device for manufacturing an engine block has a casting mold with mold parts and cylinder liners. The mold parts have a seat with seat surfaces for each cylinder liner, and the opposed ends of the cylinder liner are seated in the seat surfaces. The cylinder liners become connected to the material cast in the casting mold and are removed together with the cast material from the mold parts after casting. The seat surfaces are conical and inclined at an incline angle relative to the cross-sectional plane of the cylinder liner seated in the seat such that the opposed ends of the cylinder liner remain seated at the seat surfaces upon heat expansion of the cylinder liner during preparation of the casting mold for casting and during casting.

11 Claims, 2 Drawing Sheets

DEVICE AND METHOD FOR MANUFACTURING AN ENGINE BLOCK

BACKGROUND OF THE INVENTION

1. Field of the Invention

The present invention relates to a device and a method for manufacturing an engine block, wherein cylinder liners are integrated into the casting mold for bonding the cylinder liners to the cast material and wherein the cylinder liners are secured in a seat having seat surfaces engaging the cylinder liner ends.

2. Description of the Related Art

The aforementioned casting mold is thus formed in part by the cylinder liners delimiting the hollow space of the casting mold. After solidification of the cast material, the cylinder liners are embedded in the engine block and are detached from the mold parts upon removal of the engine block. In order to prevent the cast material form cooling too fast during casting when coming into contact with the cylinder liners and to prevent the resulting incomplete bonding of the cylinder liners within the engine block, the cylinder liners are pre-heated, preferably inductively. During this pre-heating, and to a reduced extent later during casting, the cylinder liners expand causing an undesirable movability of the cylinder liners in their seats. This may cause the cylinder liners to become positioned in the engine block in a position that differs from the desired one. This movability may entail undesirable parallel movement of the cylinder liners as well as slanting of the cylinder axis.

SUMMARY OF THE INVENTION

Therefore, it is the primary object of the present invention to provide a new casting mold and casting method of the aforementioned kind with which the manufacture of engine blocks is possible with greater precision than with casting molds and casting methods of the prior art.

In accordance with the present invention, at least one of the seat surfaces is conical and has an incline angle relative to the cross-sectional plane of the cylinder liners such that the ends of the cylinder liner remain in contact with the seat surfaces upon heat expansion of the cylinder liners during casting preparation and during casting.

Preferably, the seat surfaces are conical and have an incline angle $\alpha 1$ or $\alpha 2$ relative to the cross-sectional plane of the cylinder liner, and the condition $\tan \alpha 1 + \tan \alpha 2 = l/r$ is fulfilled, wherein l is the axial liner length between points of attack at the seat surfaces and r indicates the corresponding radius.

The invention ensures that during heat expansion, independent of the expansion state, the cylinder liner at all times rests with its ends against the conical seat surfaces so that centering of the cylinder liners is ensured in addition to a sealing action being provided with respect to liquid cast material. The cylinder liner axis can neither be moved in parallel nor can it become inclined. After cooling and solidification of the cast material, the cylinder liners are now embedded precisely in the desired arrangement within the engine block.

In a further embodiment of the invention the angles $\alpha 1$ and $\alpha 2$ are identical and correspond to the angle $\alpha$ so that $\tan \alpha = l/d$, wherein $d = 2r$ corresponds to the diameter of the liner at the length l. For a cylinder liner with conical end surfaces, the equations $\tan \alpha 1 + \tan \alpha 2 = l/r$ and $\tan \alpha = l/d$ must be fulfilled for each radius r from the inner to the outer radius of the cylinder liner and its corresponding length l. While in the embodiment with different angles $\alpha 1$ and $\alpha 2$ an axial displacement of the center of gravity of the cylinder liner results during heat expansion, no such displacement occurs when the angles $\alpha 1$ and $\alpha 2$ are identical.

In a preferred embodiment, the cylinder liners have conical end surfaces which are slanted to match the seat surfaces. Advantageously, such matching seat surfaces and cylinder liner end surfaces provide improved guiding for the centering action. Since the matching surfaces glide relatively easily on one another, the casting mold cannot be damaged during the casting process by the heat expansion of the cylinder liners.

In a further advantageous embodiment of the invention the end surfaces can project past the seat surfaces so that a respective annular undercut is formed which can be filled by the cast material and which realizes an especially stable embedding of the cylinder liner in the cast material.

Preferably, the cast material for the engine block is aluminum or an aluminum alloy and the material for the cylinder liner is gray cast iron, aluminum, or an aluminum alloy.

The cylinder liners can be provided at their exterior with profilings so that axial movement and rotational movement are made more difficult. The cylinder liners are thus especially securely embedded in the cast material.

For realizing a fixed connection of the cylinder liners to the cast material, it is also possible to provide the exterior of the cylinder liners with a coating which produces a metallic connection between the cylinder liners and the cast material. Such a coating can be, for example, AlSi5, AlSi9, or Zn.

DESCRIPTION OF THE PREFERRED EMBODIMENTS

Figure 1:
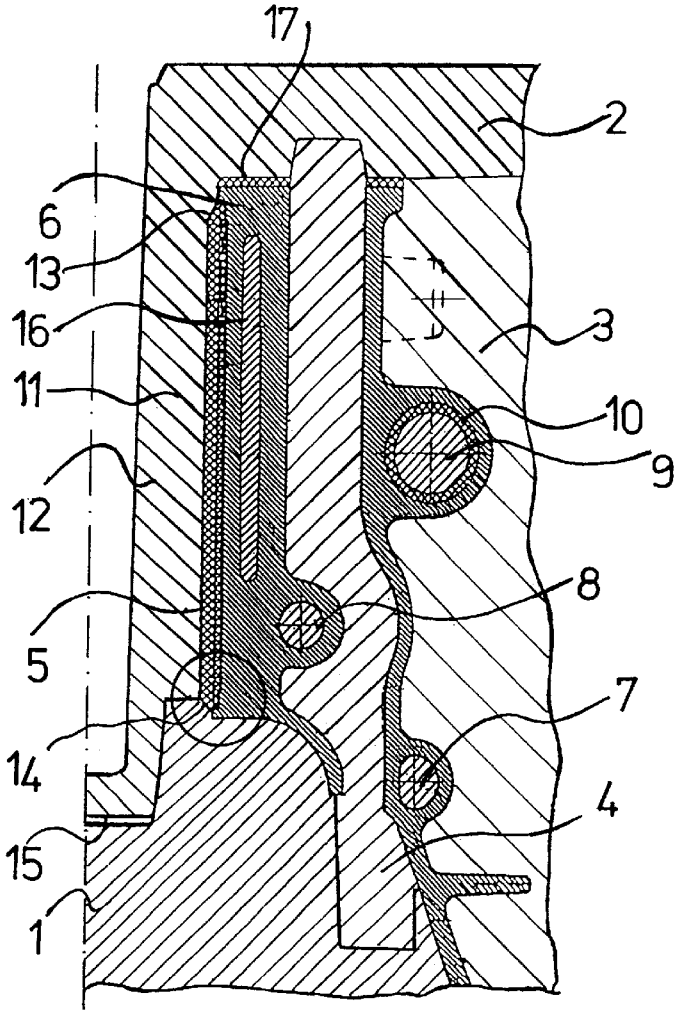
FIG. 1 shows a partial sectional view of the inventive casting mold.

The reference numerals 1 through 4 indicate the mold parts of a casting mold for producing an engine block comprising multiple cylinders. The casting molds are comprised of sand having a resin binder as an additive. In the sectional views of FIGS. 1 and 2 a portion of a cylinder liner 5 for a cylinder is visible. The cylinder liner 5 comprised of gray cast iron forms an auxiliary portion of the casting mold. It delimits with its exterior surface the hollow space 6 of the casting mold to be filled with cast material. The hollow space 6 is further delimited by the aforementioned mold parts 1 through 4. The hollow space 6 comprises the tightly hatched areas of FIGS. 1 and 2.

Pegs 7, 8, and 9 to be burnt out are positioned within the hollow space 6. The double hatched area 10 adjacent to the peg 9 is designed to be removed during after machining of the cast material.

The mold part 2 comprises a slightly conical mandrel 12 on which the cylinder liner 5 is seated. The mandrel 12 has a mantle surface 11 facing the inner side of the liner. Seat surfaces 13 and 14 define the seat for the cylinder liner 5 wherein the conical seat surface 14 is formed at the mold part 1 and the conical seat surface the 13 is formed at the mold part 2. The mandrel 12 of the mold part 2 extends into a recess 15 extending coaxially to the cylinder liner 5.

The reference numeral 16 indicates a core arranged in the hollow space 6 for forming a coolant cavity. Reference numeral 17 indicates an area like the area 10 designed for cutting removal of cast material by cutting in an after machining process step. A portion of the cylinder liner 5 facing the mandrel 12 will also be removed later by machining.

Figure 2:
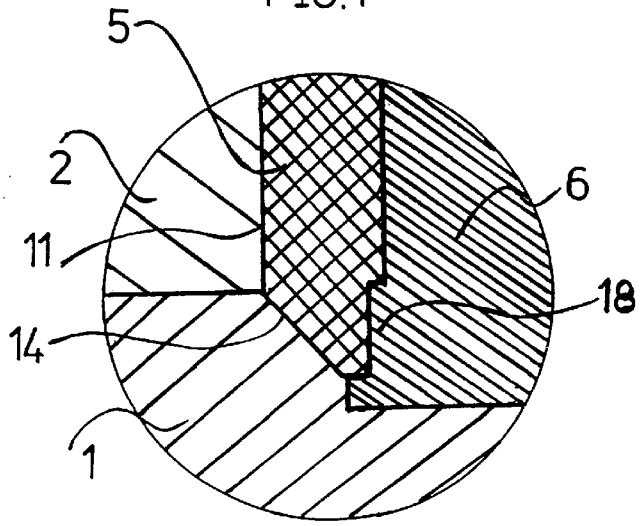
FIG. 2 shows a detail of the partial sectional view of FIG. 1.

As can be seen especially in FIG. 2, the ends of the cylinder liner 5 having conical end surfaces matching the seat surfaces 13 and 14 are provided with a step 18 which contributes to providing a fixed connection between the cast material and the cylinder liner and especially counteracts axial movement of the cylinder liner. The aforementioned conical end surfaces can project past the conical seat surfaces by forming an annular undercut to be filled by cast material.

The function of the casting mold disclosed in connection with FIGS. 1 and 2 will now be explained with the aid of FIG. 3.

The casting mold is assembled by mounting the mold parts 1 through 4 and the cylinder liner 5 so that a hollow space 6 is formed. The cylinder liner 5 which delimits the hollow space 6 is immobile and securely held by the conical seat surfaces 13 and 14.

During preparation for casting, the cylinder liners 5 are heated by a non-represented induction heating device. The heating step results in expansion of the cylinder liners.

Upon casting of the cast material, which is aluminum in the disclosed embodiment, into the hollow space 6, further expansion and heating of the cylinder liners 5 will result.

Figure 3:
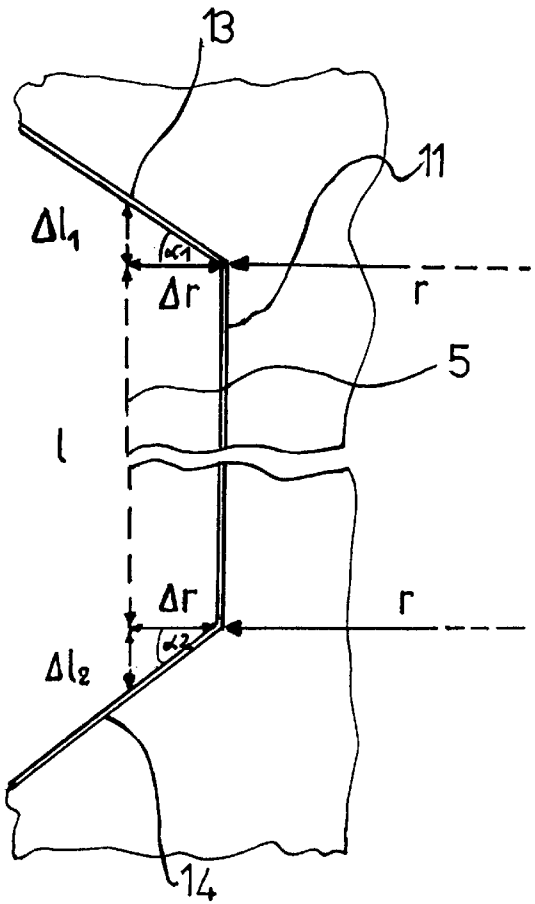
FIG. 3 is a view for illustrating the processes during heat expansion with cylinder liners integrated in a casting mold of FIG. 1.

As can be seen in FIG. 3, during this expansion the inner side of the cylinder liner 5 moves away from the mantle seat surface 11 of the mandrel 12 by a spacing $\Delta r$, i.e., the inner radius r of the cylinder liner 5 grows by $\Delta r$. Simultaneous to this expansion of the cylinder liner 5, the length of the cylinder liner 5 at its inner radius will grow by the amount $\Delta l1+\Delta l2$. This length change at the inner radius and all other length changes caused by the heat expansion of the inner liner 5 upon exposure to heat are selected in relation to the respective initial radius such that the conical end surfaces of the cylinder liner 5 remain in contact at or are guided at the conical seat surfaces 13 and 14 such that neither an undesirable slanting nor a parallel movement of the cylinder liner axis can occur. The cylinder liner 5 is thus maintained in a position, despite its heat expansion independent of the expansions state, such that after cooling of the cast material the desired position of the cylinder liner 5 in the engine block is precisely achieved.

The disclosed expansion of the cylinder liner 5 with gliding contact at the conical seat surfaces 13 and 14 is ensured, as will be demonstrated in the following, when the following condition is fulfilled: $\tan \alpha 1+\tan \alpha 2=l/r$.

For the change $\Delta l$ of the length l and the change $\Delta r$ of the radius r the following applies:

$$\Delta l=a\times l \tag{1}$$

and $$\Delta r=a\times r \tag{2}$$

wherein a is a multiplying factor comprising the longitudinal expansion coefficient.

On the other hand, for a length change $\Delta l$ the following applies:

$$\Delta l=\Delta l1+\Delta l2 \tag{3}$$

i.e., the length change $\Delta l$ is comprised of the length change $\Delta l1$ and $\Delta l2$, as can be seen in FIG. 3.

As can be seen also in FIG. 3, the following results:

$$\Delta l1=\Delta r\times\tan \alpha 1 \tag{4}$$

and $$\Delta l2=\Delta r\times\tan \alpha 2 \tag{5}$$

When the equations (4) and (5), and subsequently (1) and (2), are entered into equation (3), the above mentioned condition results.

Figure 4:
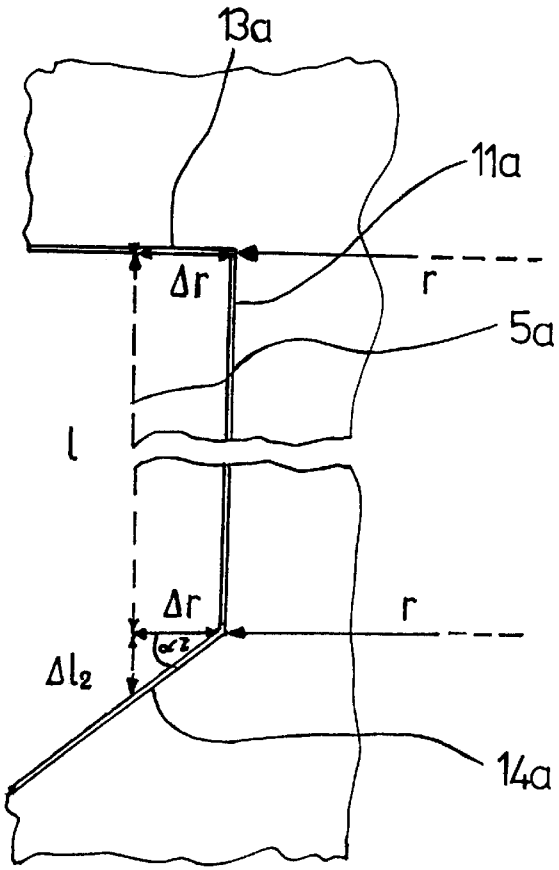
FIG. 4 shows a view corresponding to FIG. 3 for illustrating the processes during heat expansion of a cylinder liner in a casting mold according to a further embodiment of the present invention.

In the embodiment according to FIG. 3, the angles $\alpha 1$ and $\alpha 2$ are substantially identical. In the embodiment according to FIG. 4, the angle $\alpha 1$ approaches zero. The length change $\Delta l$ of the length l is thus identical to $\Delta l2$ and $\tan \alpha 1$ in the aforementioned equation is zero. In FIG. 4, same parts are identified with same reference numerals as in FIG. 3, with the difference that the letter "a" has been added. Shown are the cylinder liner 5*a*, guided on the conical seat surfaces 13*a* and 14*a*, and the mantle surface 11*a*. Accordingly, for the embodiment of FIG. 4, the following equation results: $\tan \alpha 2=l/r$ When the angle $\alpha 1$ and $\alpha 2$ are identical and correspond to the angle $\alpha$, then the following applies: $2 \tan \alpha=l/r$. This results in $\tan \alpha=l/2r=l/d$, wherein d is the inner diameter, the outer diameter, or the diameter between the inner diameter and the outer diameter of the cylinder liner, and wherein l is the corresponding length of the cylinder liner.

While specific embodiments of the invention have been shown and described in detail to illustrate the inventive principles, it will be understood that the invention may be embodied otherwise without departing from such principles.

What is claimed is:

1. A device for manufacturing an engine block comprising:

a casting mold comprising mold parts and cylinder liners;

the mold parts having a seat, comprised of two seat surfaces, for each one of the cylinder liners, wherein the cylinder liners have opposed ends seated in the two seat surfaces of the seats;

the cylinder liners configured to become connected to a cast material cast in the casting mold and configured to be removed together with the cast material from the mold parts after casting;

wherein the two seat surfaces of each one of the seats is conical and inclined at an incline angle $\alpha 1$ and $\alpha 2$, respectively, relative to a cross-sectional plane of the cylinder liner seated in the seat such that the opposed ends of the cylinder liner remain seated at the two seat surfaces upon heat expansion of the cylinder liner during preparation of the casting mold for casting and during casting.

2. The device according to claim 1, wherein the incline angles $\alpha 1$ and $\alpha 2$ of the seat surfaces are defined by $\tan \alpha 1+\tan \alpha 2=l/r$, wherein l is a length of the cylinder liner between points of attack of the opposed ends of the cylinder liner at the seat surfaces and wherein r is a radius of the cylinder liner at the points of attack.

3. The device according to claim 2, wherein the incline angles $\alpha 1$ and $\alpha 2$ of the seat surfaces are identical so that $\tan \alpha=l/d$, wherein $\alpha=\alpha 1=\alpha 2$ and wherein d is a diameter at the length l.

4. The device according to claim 1, wherein the opposed ends of the cylinder liner has conical end surfaces configured to match the conical seat surfaces of the seat.

5. The device according to claim 4, wherein the opposed ends have an annular undercut projecting radially outwardly past the seat surfaces and configured to be filled with the cast material.

6. The device according to claim 1, wherein the cast material is aluminum or an aluminum alloy.

7. The device according to claim 1, wherein the cylinder liners are made of gray cast iron, aluminum, or an aluminum alloy.

8. The device according to claim 1, wherein the cylinder liners have outer profilings.

9. The device according to claim 1, wherein the cylinder liners have an outer coating for producing a metallic connection between the cylinder liners and the cast material.

10. The device according to claim 9, wherein the outer coating is comprised of at least one material selected from the group consisting of AlSi5, AlSi9, and Zn.

11. A method of manufacturing an engine block in a casting mold, the method comprising the steps of:

providing mold parts having seats each comprised of two seat surfaces;

placing a cylinder liner having opposed ends configured to match the two seat surfaces into each one of the seats to complete the casting mold, wherein the cylinder liners are configured to become connected to a cast material cast in the casting mold and configured to be removed together with the cast material from the mold parts after casting;

configuring the two seat surfaces of each one of the seats to be conical and inclined at an incline angle relative to a cross-sectional plane of the cylinder liner seated in the seat such that the opposed ends of the cylinder liner remain seated at the two seat surfaces upon heat expansion of the cylinder liner during preparation of the casting mold for casting and during casting.

* * * * *